US010020599B1

(12) United States Patent
Lepez et al.

(10) Patent No.: US 10,020,599 B1
(45) Date of Patent: Jul. 10, 2018

(54) CONNECTOR BACK SHELL ASSEMBLY

(71) Applicant: Delphi Technologies, Inc., Troy, MI (US)

(72) Inventors: Dennis Garcia Lepez, Coahuila (MX); Cynthia Fraga Hernandez, Coahuila (MX); Alejandro Garcia Cabello, Coahuila (MX)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/647,666

(22) Filed: Jul. 12, 2017

(51) Int. Cl.

| | |
|---|---|
| ***H01R 3/00*** | (2006.01) |
| ***H01R 4/2458*** | (2018.01) |
| ***H01R 13/436*** | (2006.01) |
| ***H01R 13/639*** | (2006.01) |
| *H01R 13/74* | (2006.01) |
| *H01R 13/52* | (2006.01) |

(52) U.S. Cl.
CPC ..... *H01R 4/2458* (2013.01); *H01R 13/4368* (2013.01); *H01R 13/6397* (2013.01); *H01R 13/5221* (2013.01); *H01R 13/743* (2013.01)

(58) Field of Classification Search
CPC ..... H01R 13/516; H01R 13/5829; H01R 13/5845; H01R 13/5841; H01R 13/502
USPC ..... 439/465, 446, 467, 470
See application file for complete search history.

(56) References Cited

U.S. PATENT DOCUMENTS

| | | | | |
|---|---|---|---|---|
| 4,398,780 | A * | 8/1983 | Novotny | H01R 13/6592 439/284 |
| 5,908,327 | A * | 6/1999 | Tsuji | H01R 13/506 439/470 |
| 5,967,830 | A * | 10/1999 | Tsuji | H01R 13/506 439/467 |
| 9,461,400 | B2 * | 10/2016 | Kanda | H01R 13/5829 |
| 2009/0258540 | A1 * | 10/2009 | Kameyama | H01R 13/502 439/607.55 |
| 2016/0093984 | A1 * | 3/2016 | Iwamoto | H01R 13/6581 439/607.55 |

* cited by examiner

*Primary Examiner* — Abdullah Riyami
*Assistant Examiner* — Thang Nguyen
(74) *Attorney, Agent, or Firm* — Robert J Myers

(57) ABSTRACT

A back shell is described herein. The back shell is configured to be attached to a connector body defining a first attaching feature in its outer surface. The back shell has an attachment portion defining a second attaching feature and a generally tubular support portion extending from this attachment portion. The second attaching feature is configured to engage the first attaching feature of the connector body to secure the back shell to the connector body. An outer surface of the attachment portion of the back shell defines a third attaching feature that is identical in configuration and function to the first attaching feature.

5 Claims, 6 Drawing Sheets

CONNECTOR BACK SHELL ASSEMBLY

TECHNICAL FIELD OF THE INVENTION

The invention generally relates to a connector assembly configured to interconnect electrical cables, and more particularly relates to a connector assembly which includes a back shell.

BACKGROUND OF THE INVENTION

When designing a cable assembly, engineers need to consider a connector back shell for protecting the connector, so it can safeguard the reliability of the cable and ultimately the entire system. The purpose of a back shell is to prevent separation of cable wires from connector assemblies caused by cable tension or bending. The weakest point in a multi-wire electrical cable is where the wires are connected to a terminal. Any tension in the wire may cause uncoupling of wire from the connector, and a corresponding loss of data or power transfer. Likewise, bending of a cable near one of its attached connectors causes tension in the outer wires of the cable resulting in possible wire separation from the connector and loss of electrical contact. Back shells were devised to allow stress due to tension or bending to be transmitted away from the joint between the cable and connector by the connector and back shell instead of by the wires.

A back shell cover is an individual part from the connector placed and plugged around of it, used to attach, secure and give direction to the cable, thereby providing strain relief to the solder joints or crimped connections by preventing mechanical loading from the attached wire of the cable. Depending on the design of the back shell, it can also prevent the ingress of dirt, moisture or liquids into the connector. The back shell ensures that the cables are never bent to an excessive angle, typically not more than 13 degrees away from the connector longitudinal axis of the connector.

The use of a back shell with a connector typically requires a connector body having dedicated attachment features to secure the back shell to the connector body. This may limit the connector types available for the cable designer and increase production cost by requiring dedicated connector body designs for use with a back shell. Therefore a connector assembly including a back shell that can be used with connector bodies without dedicated back shell attachment features remain desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, a back shell configured to be attached to a connector body having a first outer surface defining a first attaching feature is provided. The back shell includes an attachment portion defining a second attaching feature and a generally tubular support portion extending from the attachment portion. The second attaching feature is configured to engage the first attaching feature of the connector body. The attachment portion has a second outer surface defining a third attaching feature that is identical in configuration and function to the first attaching feature.

According to one particular embodiment, the first attaching feature includes a rectangular first slot defined in the first outer surface of the connector body. The first slot extends longitudinally along the first outer surface and extends through the first outer surface to a rectangular first cavity within the connector body. The first cavity extends longitudinally and in parallel to the first slot. The first cavity has a first lateral width and the first slot has a second lateral width that is less than the first lateral width. The first attaching feature further comprises a first locking tang protruding from the first outer surface. The first locking tang is located forward of the first slot.

Further according to this one particular embodiment, the second attaching feature includes a T-shaped rail having a vertical rail portion extending longitudinally and vertically from the attachment portion and further having a lateral rail portion extending longitudinally and laterally from the vertical rail portion. The vertical rail portion is configured to be received within the first slot of the first attaching feature. The vertical rail portion has a third lateral width that is less than the first lateral width. The lateral rail portion is configured to be received within the first cavity of the first attaching feature. The lateral rail portion has a fourth lateral width that is greater than the first lateral width of the first slot and less than the second lateral width of the first cavity. The second attaching feature further comprises a flexible locking tab defining an aperture configured to engage the first locking tang of the first attaching feature.

Additionally according to this one particular embodiment, the third attaching feature includes a rectangular second slot defined in the outer surface of the back shell. The second slot extend longitudinally along the outer surface of the back shell and extends through the outer surface of the back shell to a rectangular second cavity within the attachment portion of the back shell that extends longitudinally and in parallel to the second slot. The second cavity has the same lateral width as the first cavity and the second slot has the same lateral width as the first slot. The third attaching feature further includes a second locking tang protruding from the outer surface of the back shell and is located forward of the second slot.

The first cavity of the connector body may include a first floor that is generally parallel to the outer surface of the connector body and the second cavity of the back shell includes a second floor that is generally parallel to the outer surface of the back shell.

In accordance with another embodiment of the invention, a connector assembly is provided. The connector assembly includes a connector body having an outer surface defining a first attaching feature and the back shell described above. The first attaching feature of the connector body is engaged with the second attaching feature of the back shell, thereby securing the back shell to the connector body.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

In the following description, orientation terms such as "longitudinal" will refer to the axis X while "lateral" refers to a Y-axis perpendicular to the X-axis, which is not necessarily the transverse axis. Furthermore, terms relating to "top" "bottom", "upper", and "lower" are to be understood relative to a Z axis perpendicular to the X-axis, which is not necessarily the vertical axis. As used herein the terms "front" and "forward" refer to a longitudinal orientation in a direction of insertion and the terms "back", "rear", "rearward", and "behind" refer to a longitudinal orientation opposite the direction of insertion.

Figure 1:
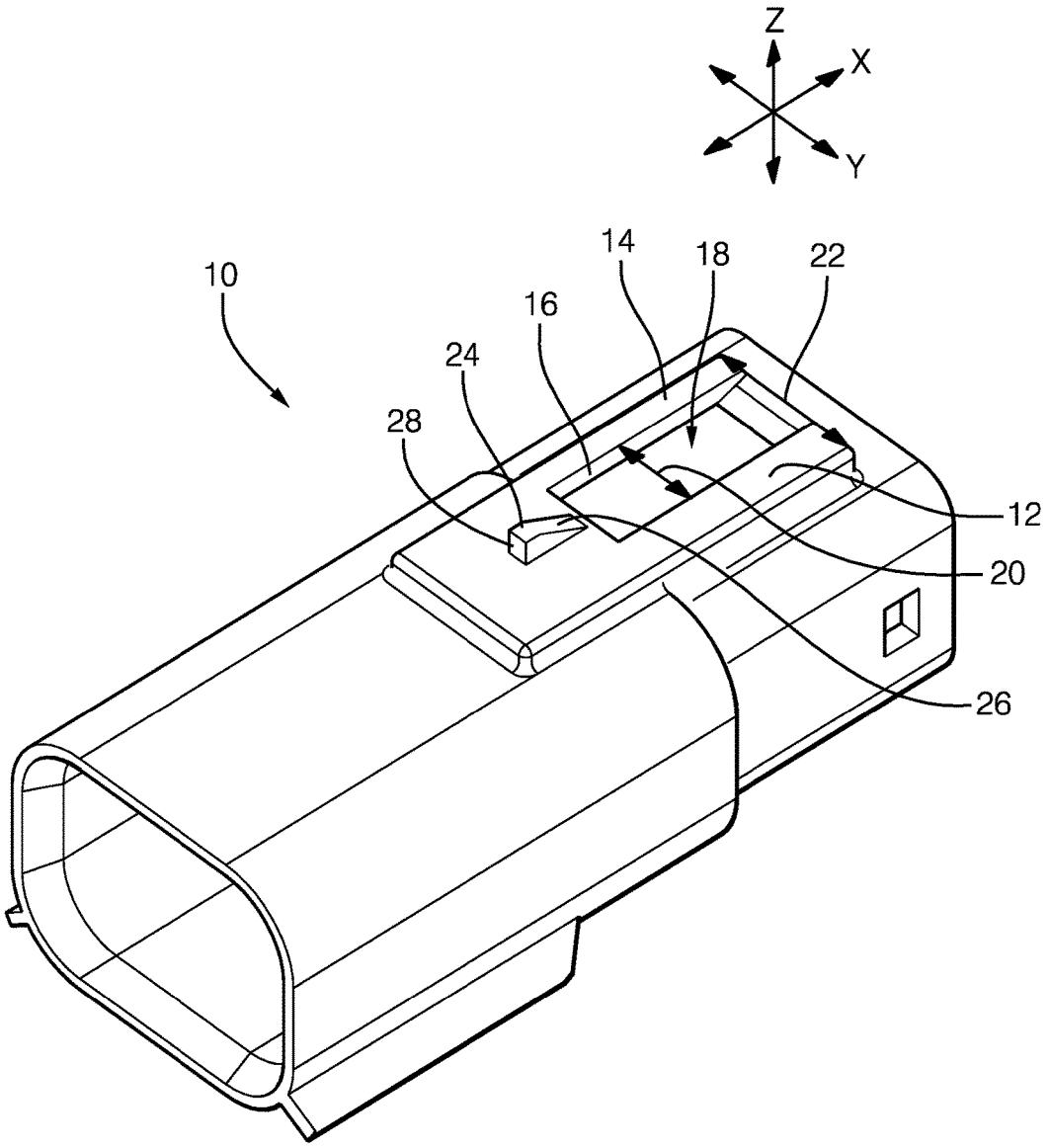
PRIOR ART FIG. 1
FIG. 1 a perspective view of a connector body according to the prior art.
Figure 2:
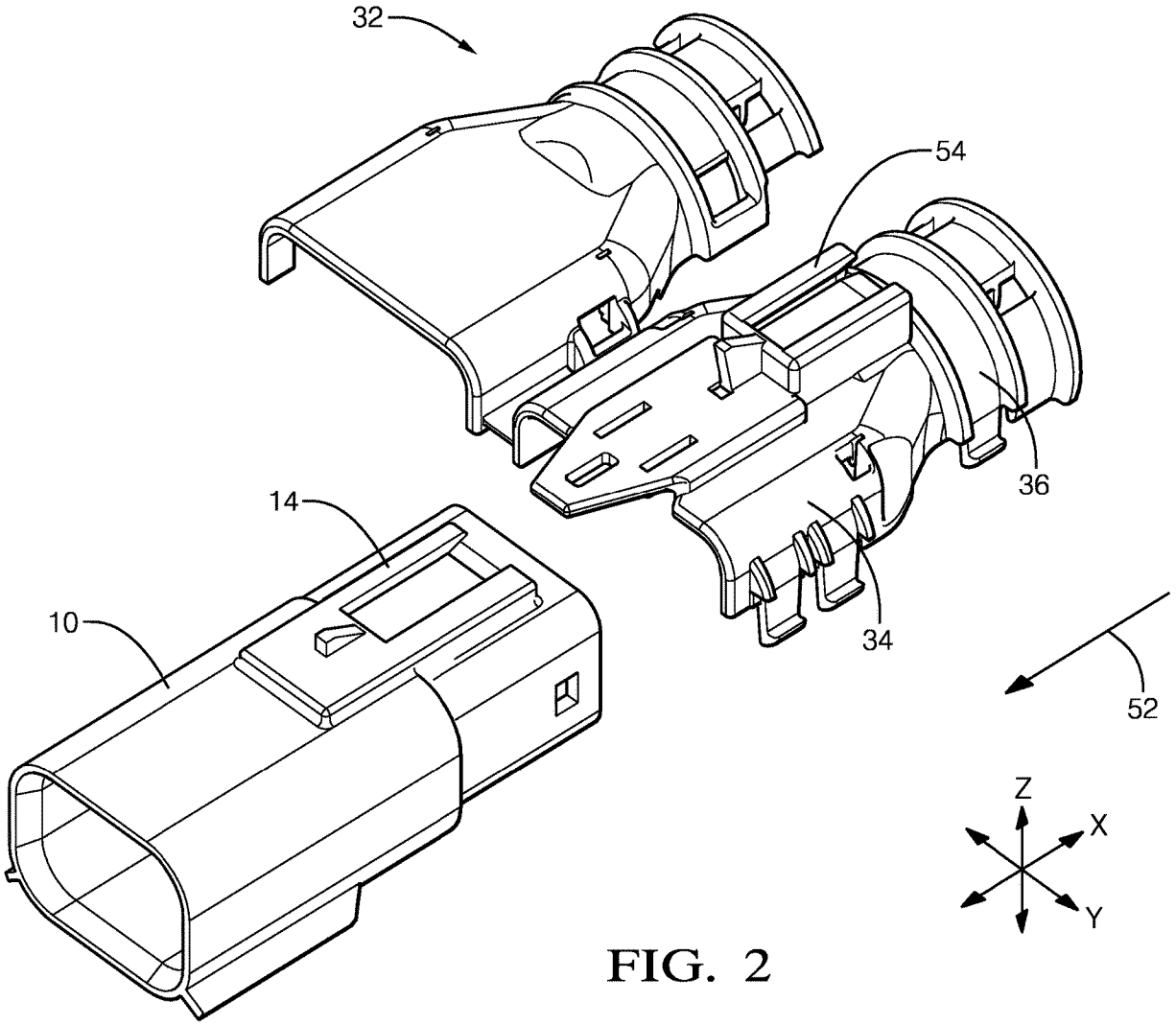
FIG. 2 is an exploded perspective view of a connector assembly having a back shell in accordance with an embodiment of the invention and the connector body of FIG. 1.

FIG. 1 illustrates a non-limiting example of a prior art connector body 10 that is part of a connector assembly (see FIG. 2) used to interconnect electrical wire cables (not shown). The connector body 10 defines a plurality of terminal cavities (not shown) configured to receive electrical terminals (not shown) attached to the ends of electrical wires (not shown) in the wire cable. An outer surface 12 of the connector body 10, hereinafter referred to as the first outer surface 12, defines an attaching feature 14, hereinafter referred to as the first attaching feature 14, that may be used to attach the connector body 10 to another element (not shown), e.g. a support structure in a motor vehicle, in order to secure the connector assembly. The first attaching feature conforms to an automotive industrial standard. The connector body 10 is preferably formed of an dielectric material, such as polybutylene terephthalate (PBT) or polyamide (PA, NYLON).

The first attaching feature 14 of the connector body 10 includes a rectangular slot 16, hereinafter referred to as the first slot 16, that is defined in the first outer surface 12. This first slot 16 extends longitudinally in parallel to the X-axis and extends through the first outer surface 12 to a rectangular cavity 18 within the connector body 10, hereinafter referred to as the first cavity 18. The first cavity 18 also extends longitudinally and is parallel to the first slot 16. The first slot 16 is laterally centered relative to the first cavity 18. A lateral width 20 of the first slot 16 is less than a lateral width 22 of the first cavity 18. The first attaching feature 14 further includes a locking tang 24, hereinafter referred to as the first locking tang 24, protruding from the first outer surface 12 of the connector body 10. The first locking tang 24 has a generally rectangular base on the first outer surface 12 with the major axis of the base parallel to the X-axis. The rearward edge 26 the first locking tang 24 is ramped forwardly forming an acute angle relative to the first outer surface 12, preferably an acute angle in the range of 30° to 45°. The forward edge 28 of the first locking tang 24 forms a right angle or is ramped slightly forwardly to form an obtuse angle relative to the first outer surface 12, preferably an obtuse angle in the range of 90° to 105°. The first locking tang 24 is located forward of the first slot 16.

Figure 3:
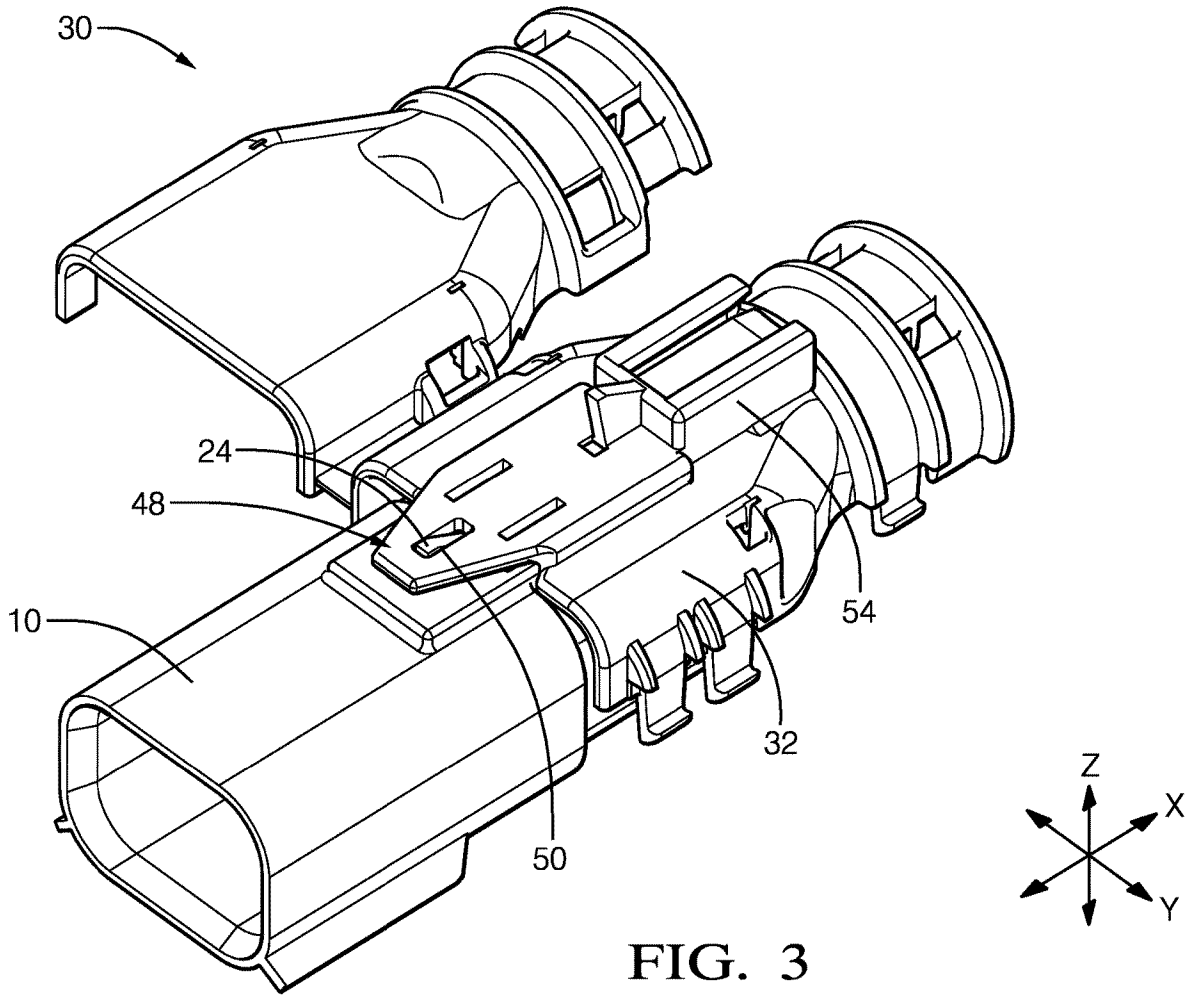
FIG. 3 is a perspective view of the connector assembly of FIG. 2 in accordance with an embodiment of the invention.
Figure 4:
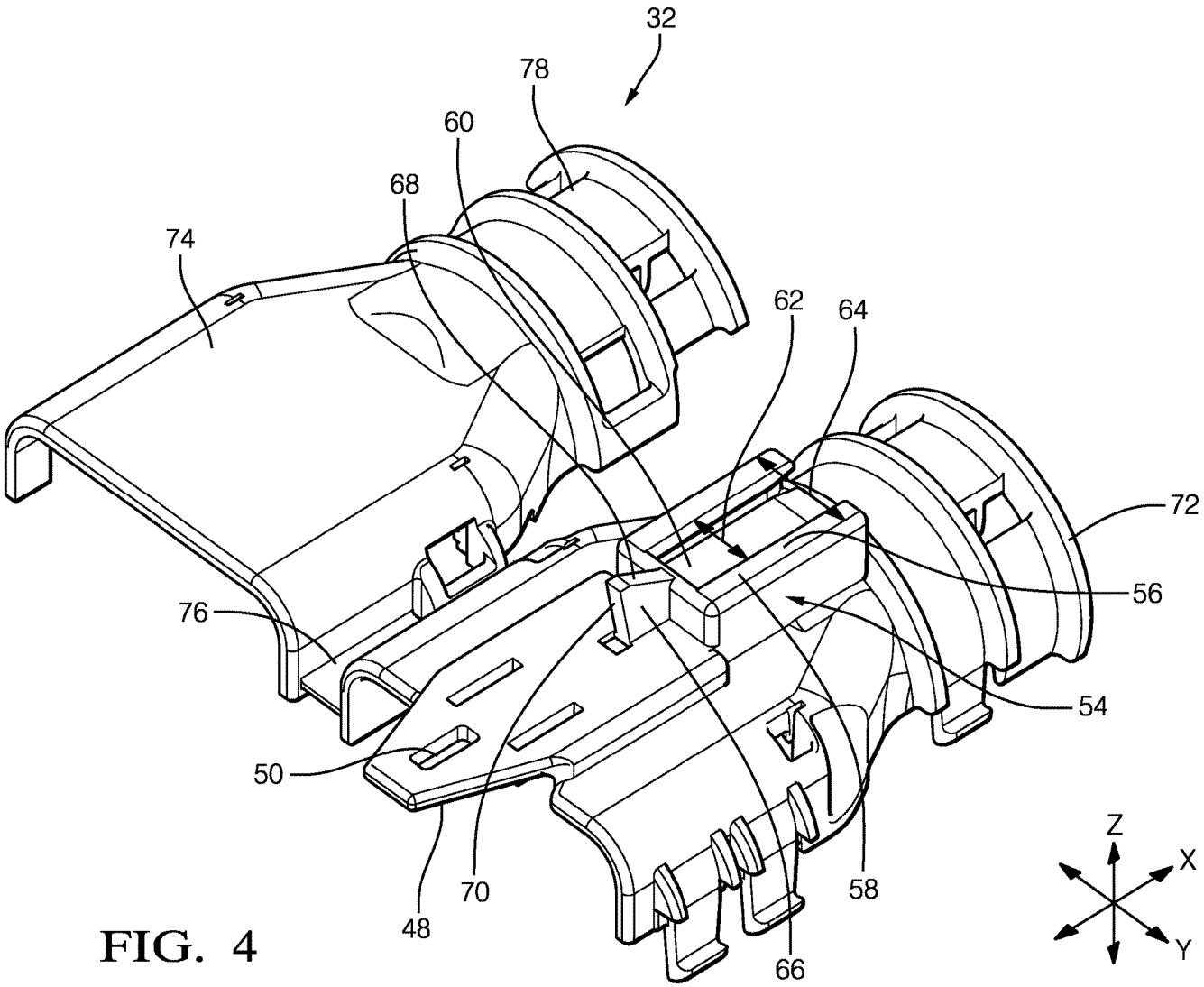
FIG. 4 a top perspective view of a back shell of FIG. 2 in accordance with an embodiment of the invention.
Figure 5:
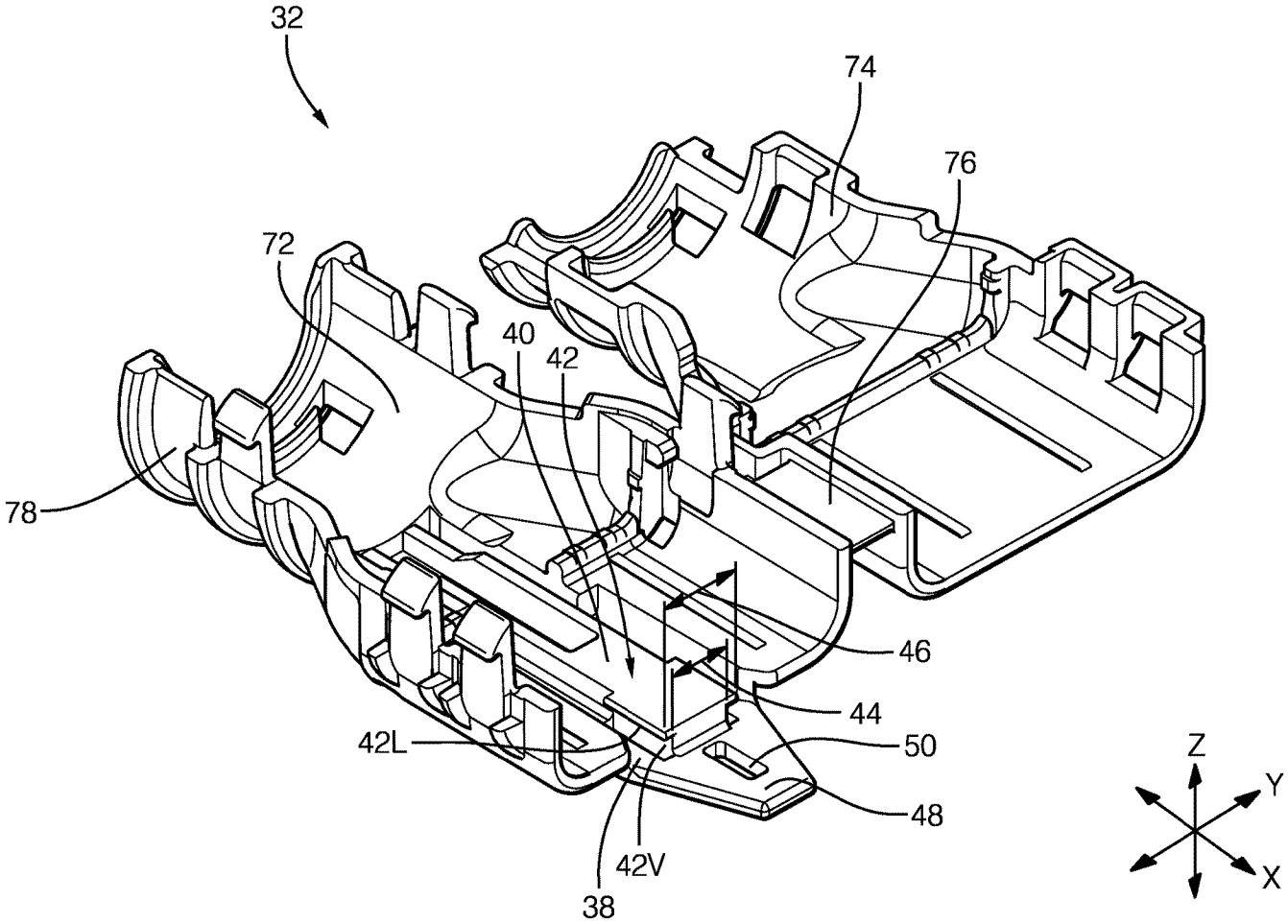
FIG. 5 is bottom perspective view of the back shell of of FIG. 2 in accordance with an embodiment of the invention.

FIGS. 2-6 illustrate a non-limiting example of a connector assembly 30 including the connector body 10 described above and a back shell 32 attached to the connector body 10 as illustrated in FIG. 3. The back shell 32 an attachment portion 34 configured to connect the back shell 32 to the connector body 10 and a generally tubular support portion 36 extending from the attachment portion 34. The support portion 36 is configured to provide strain relief to the solder joints or crimped connections between the wires and the terminal. The back shell 32 ensures that the cables are never bent to an excessive angle, typically not more than 13 degrees away from parallel with the X-axis. The back shell 32 is preferably formed of a dielectric material, such as polyamide, more preferably heat stabilized impact modified polyamide 66 (PA66 IM HS). As best illustrated in FIG. 5, an inner surface 38 of the attachment portion 34 includes a corresponding attaching feature 40, hereinafter referred to as the second attaching feature 40, that is configured to engage the first attaching feature 14 of the connector body 10, thereby securing the back shell 32 to the connector body 10.

Figure 6:
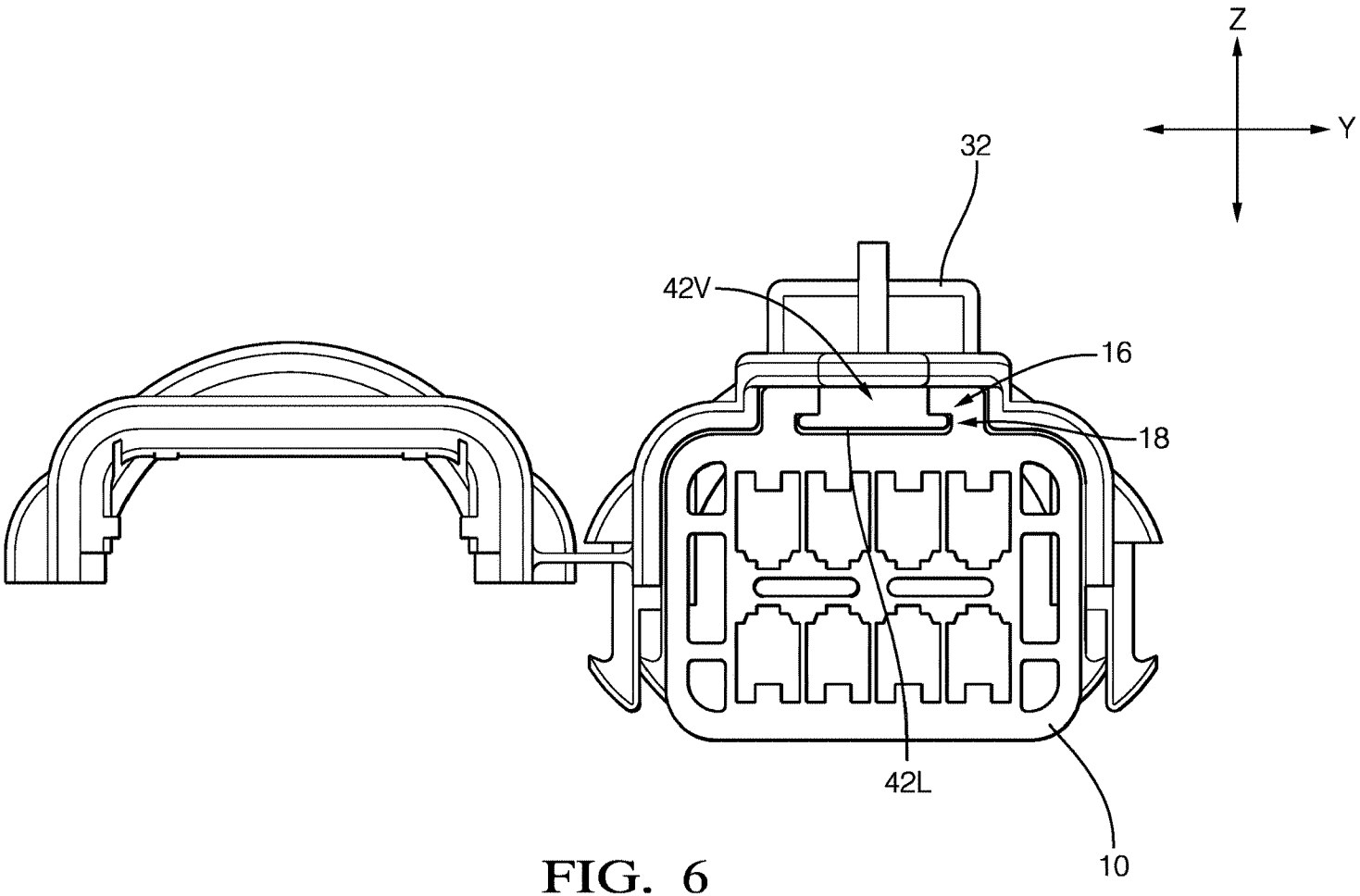
FIG. 6 is an end view of a connector assembly of FIG. 2 in accordance with an embodiment of the invention.

As best illustrated in FIGS. 5 and 6, the second attaching feature 40 includes a T-shaped rail 42 which includes a vertical rail portion 42V and a lateral rail portion 42L. The vertical rail portion 42V has a generally rectangular cross section and extends from the attachment portion 34 longitudinally, i.e. parallel to the X-axis, and vertically, i.e. parallel to the Z-axis. The lateral rail portion 42L extends from the vertical rail portion 42V longitudinally, i.e. parallel to the X-axis, and laterally, i.e. parallel to the Y-axis. The lateral rail portion 42L is generally centered about the vertical rail portion 42V. The vertical rail portion 42V is configured to be received within the first slot 16 of the first attaching feature 14 as illustrated in FIG. 6 while the lateral rail portion 42L is configured to be received within the first cavity 18 of the first attaching feature 14. A lateral width 44 of the vertical rail portion 42V is less than the lateral width 20 of the first slot 16. A lateral width 46 of the lateral rail portion 42L is greater than the lateral width 20 of the first slot 16 and less than the lateral width 22 of the first cavity 18. The second attaching feature 40 further includes a flexible locking tab 48 defining a generally rectangular aperture 50 that is slightly larger than the base of the first attaching feature 14. The aperture 50 is configured to engage the first locking tang 24 of the first attaching feature 14 as the t-shaped rail 42 of the second attaching feature 40 is fully inserted within the first cavity 18 and first slot 16 of the first attaching feature 14 in an insertion direction 52 that is parallel with the X-axis.

Without subscribing to any particular theory of operation, as the t-shaped rail 42 of the second attaching feature 40 is fully inserted within the first cavity 18 and first slot 16 of the first attaching feature 14, a forward end of the flexible locking tab 48 contacts the rearward edge 26 of the first locking tang 24, flexing against the ramped surface of the rearward edge 26 until a forward end of the aperture 50 clears the forward edge 28 of the first locking tab at which point the flexible locking tab 48 returns to its original shape, thereby engaging the forward end of the aperture 50 with the forward edge 28 of the flexible locking tab 48 and inhibiting removal of the t-shaped rail 42 of the second attaching feature 40 from the first cavity 18 and first slot 16 of the first attaching feature 14.

The back shell 32 includes another attaching feature 54, hereinafter referred to as the third attaching feature 54, that is identical to the first attaching feature 14. As used herein, "identical" means being the same or having such close resemblance as to be essentially the same. The third attaching feature 54 of the back shell 32 includes a rectangular slot 56, hereinafter referred to as the second slot 56, that is defined in an outer surface 58 of the back shell 32, hereinafter referred to as the second outer surface 58. This second slot 56 extends longitudinally in parallel to the X-axis and extends through the second outer surface 58 to a rectangular cavity 60 within the back shell 32, hereinafter referred to as the second cavity 60. The second cavity 60 also extends longitudinally and is parallel to the first slot 16. The second slot 56 is laterally centered relative to the second cavity 60. A lateral width 62 of the second slot 56 is the same as the lateral width 20 of the first slot 16 and a lateral width 64 of the second cavity 60 is the same as the lateral width 22 of the first cavity 18.

The third attaching feature 54 further includes a second locking tang 66 protruding from the second outer surface 58 of the back shell 32. The second locking tang 66 has a generally rectangular base on the second outer surface 58 with the major axis of the base parallel to the X-axis. The rearward edge 68 is ramped forwardly forming an acute angle with the second outer surface 58, preferably the same acute angle formed between the rearward edge 68 of the first locking tang 24 and the first outer surface 12. The forward edge 70 of the second locking tang 66 forms a right angle or is ramped slightly forwardly to form an obtuse angle relative to the first outer surface 12, preferably the same obtuse angle formed between the forward edge 28 of the first locking tang 24 and the first outer surface 12. The second locking tang 66 is located forward of the second slot 56. The third attaching feature 54 is configured to receive another attaching feature 14 identical to the second attaching feature 40 that may be used to attach the connector body 10 to another element, e.g. a support structure in a motor vehicle, in order to secure the connector assembly 30.

As best shown in FIGS. 4 and 5, the back shell 32 has an upper portion 72 and a lower portion 74 connected by a hinge feature 76, such as a living hinge running longitudinally, i.e. parallel to the X-axis, between them. This configuration allows the back shell 32 to be attached to the connector body 10 if the wire cable is protruding from the connector body 10. The upper and lower portions 72, 74 include corresponding locking features on the free ends of the back shell 32 so that the back shell 32 encircles a portion of the connector body 10. The support portion 36 of the back shell 32 includes a radial groove 76 that may receive a band, such as a wire tie, to secure the support portion 36 to the wire cable, thereby providing additional strain relief for the cable.

The embodiments presented herein are directed to connector assemblies configured to connect electrical wire cables. However, other embodiments may be envisioned that are adapted for connecting fiber optic cables, pneumatic lines, hydraulic lines, or a combination of any of these.

Accordingly, a back shell 32 and a connector system including this back shell 32 is provided. The back shell 32 provides the benefits of being configured to attach to a connector body 10 that is not specially designed for use with a back shell 32, e.g. a connector body 10 having an attaching feature 14 used to secure the connector body 10 to a support structure in a motor vehicle. The back shell 32 also provides the benefit of providing a duplicate attaching feature 54 that may be used to secure the back shell 32, and therefore the connector body 10 to which the back shell 32 is attached, to the support structure in a motor vehicle.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

In the following claims, the terms "including" and "in which" are used as the plain-English equivalents of the respective terms "comprising" and "wherein."
Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

Further, the limitations of the following claims are not written in means-plus-function format and are not intended to be interpreted based on 35 USC § 112(f), unless and until such claim limitations expressly use the phrase "means for" followed by a statement of function void of further structure.

We claim:

1. A back shell configured to be attached to a connector body having a first outer surface defining a first attaching feature, said back shell comprising:

an attachment portion defining a second attaching feature; and a generally tubular support portion extending from the attachment portion, wherein the second attaching feature is configured to engage the first attaching feature of the connector body and wherein the attachment portion has a second outer surface defining a third attaching feature that is identical in configuration and function to the first attaching feature, wherein the first attaching feature comprises a rectangular first slot defined in the first outer surface extending longitudinally along the first outer surface and extending therethrough to a rectangular first cavity within the connector body that extends longitudinally and in parallel to the first slot, wherein the first cavity has a first lateral width and the first slot has a second lateral width that is less than the first lateral width, wherein the first attaching feature further comprising a first locking tang protruding from the first outer surface and located forward of the first slot.

2. The back shell in accordance with claim 1, wherein the second attaching feature comprises a T-shaped rail having a vertical rail portion extending longitudinally and vertically from the attachment portion and a lateral rail portion extending longitudinally and laterally from the vertical rail portion, wherein the vertical rail portion is configured to be received within the first slot, wherein the vertical rail portion has a third lateral width that is less than the first lateral width, wherein the lateral rail portion is configured to be received within the first cavity, wherein the lateral rail portion has a fourth lateral width that is greater than the first lateral width and less than the second lateral width, and wherein the second attaching feature further comprises a flexible locking tab defining an aperture configured to engage the first locking tang.

3. The back shell in accordance with claim 1, wherein the third attaching feature comprises a rectangular second slot defined in the second outer surface extending longitudinally along the second outer surface and extending therethrough to a rectangular second cavity within the attachment portion that extends longitudinally and in parallel to the second slot, wherein the second cavity has the first lateral width and the second slot has the second lateral width, and wherein the third attaching feature further comprises a second locking tang protruding from the second outer surface and located forward of the second slot.

4. The back shell in accordance with claim 3, wherein the first cavity comprises a first floor generally parallel to the first outer surface and wherein the second cavity comprises a second floor generally parallel to the second outer surface.

5. A connector assembly, comprising:

a connector body having a first outer surface defining a first attaching feature; and the back shell in accordance with claim 1, wherein the first attaching feature is engaged with the second attaching feature, thereby securing the back shell to the connector body.

* * * * *